United States Patent [19]

Stroble

[11] 4,033,414

[45] July 5, 1977

[54] METHOD AND APPARATUS FOR RELEASING A DRILL STRING HELD BY DIFFERENTIAL PRESSURE

[76] Inventor: Michael F. Stroble, 1610 Pine Chase, Houston, Tex. 77055

[22] Filed: Aug. 2, 1976

[21] Appl. No.: 710,610

[52] U.S. Cl. ..... 166/301; 166/106; 166/196

[51] Int. Cl.[2] ..... E21B 31/00; E21B 33/128; E21B 41/00

[58] Field of Search ..... 166/301, 98, 178, 315, 166/101, 106, 202, 183, 196

[56] References Cited

UNITED STATES PATENTS

| | | | |
|---|---|---|---|
| 2,865,454 | 12/1958 | Richards | 166/301 |
| 3,186,483 | 6/1965 | Schwab | 166/101 X |
| 3,213,941 | 10/1965 | Nelson | 166/301 |
| 3,236,307 | 2/1966 | Brown | 166/301 |
| 3,268,003 | 8/1966 | Essary | 166/301 X |
| 3,268,004 | 8/1966 | Kiel | 166/106 |
| 3,765,487 | 10/1973 | McEver | 166/301 |
| 3,800,876 | 4/1974 | Eggleston | 166/301 |

*Primary Examiner*—Stephen J. Novosad
*Attorney, Agent, or Firm*—Jennings B. Thompson

[57] ABSTRACT

The invention disclosed includes a method of and apparatus for reducing the differential pressure holding a section of a drill string by lowering the hydrostatic pressure of the drilling fluid in the well bore adjacent the section being held. This is done by sealing the annulus between a fishing string and the well bore with a packer located above the section being held and lowering the level of drilling mud in the fishing string. In the embodiment described, the drilling mud level is lowered by swabbing drilling mud from the fishing string with a swab that is lowered and raised in the fishing string by a flexible swab line. A seal is provided between the swab line and the upper end of the fishing string to allow drilling mud to be pumped down the fishing string if necessary to for any reason, such as to circulate out a kick. The swab and the packer are provided with valves that can be opened to allow such circulation.

10 Claims, 7 Drawing Figures

METHOD AND APPARATUS FOR RELEASING A DRILL STRING HELD BY DIFFERENTIAL PRESSURE

This invention relates to a method of and apparatus for releasing stuck pipe, and in particular to releasing a section of a drill string that is held or stuck in a well bore due to differential pressure sticking.

One of the most costly problems that can occur during the drilling of oil and gas wells is the sticking of the drill string in the hole. This can occur for a number of reasons, the most common, however, is commonly called "wall sticking." The symptoms of wall sticking are easily recognized. It occurs when the drill string has remained motionless for a period of time, which period might be quite short, after which the drill string cannot be rotated or moved up and down, but the drilling mud can be circulated. Wall sticking most frequently occurs while making a connection — that is, adding another joint of pipe to the drill string — and when it occurs, the bit is usually raised off the bottom of the well bore. A drill string stuck due to wall sticking is held against movement by the differential between the hydrostatic pressure of the drilling fluid in the well bore and the formation pressure of a permeable formation through which the well bore extends.

Various methods have been practiced in the past to free a stuck drill string. Usually an attempt is first made to simply pull the stuck section from the wall of the well bore. If the differential pressure holding the pipe is such that it can be overcome in this manner, then the stuck section can be pulled free. If this doesn't work, the hydrostatic pressure holding the pipe can be reduced by diluting the drilling mud with water or oil to reduce its specific gravity, which reduces the hydrostatic pressure holding the pipe against the wall. This is not necessarily a desirable solution since it results in the dilution of very expensive drilling mud. It can also result in lowering the hydrostatic pressure to the point where formation fluid may enter the well bore creating additional problems, particularly if the formation fluid happens to be gas.

Another method used is to back off or unscrew a joint in the drill string above the point where the drill string is stuck, leaving the stuck section in the hole. This section is commonly called a "fish." The disconnected section of the drill string is removed from the hole and various well known fishing operations can be conducted in an attempt to free and reover the fish, such as washing over the fish with wash pipe. Such operations are costly and time consuming.

Obviously, the quickest and surest way of releasing the section of drill string that is stuck is to reduce the hydrostatic pressure holding the section against the wall until it can be pulled free of the wall.

It is an object of this invention to provide a method of and apparatus for quickly and easily reducing the hydrostatic pressure adjacent a section of a drill string that is held against the wall of a well bore by differential pressure until the differential pressure is reduced sufficiently for the section to be pulled away from the wall.

It is another object of this invention to provide a method of and apparatus for reducing the hydrostatic pressure in the well bore adjacent a fish held by differential pressure without reducing the specific gravity of the drilling mud in the well bore.

It is another object of this invention to provide a method of and apparatus for releasing a portion of a drill string that is tuck in a well bore by differential pressure by reducing the hydrostatic pressure in the section of the well bore adjacent the stuck portion relieving this section of the sell bore of the hydrostatic pressure of a portion of the drilling mud in the annulus above the stuck section and by lowering the level of drilling mud in the fishing string attached to the stuck portion by removing drilling mud from the fishing string.

It is another object and feature of this invention to provide such apparatus that includes a packer that is set in the annulus above the stuck portion which will allow drilling mud to be circulated upwardly in the annulus when necessary without having to unseat the packer.

It is another object and feature of this invention to provide a swab that has a valve that can be opened by lowering the swab to a predetermined position in the well bore to allow drilling mud to be circulated down the fishing string when necessary without having to remove the swab from the fishing string.

It is another object and feature of this invention to provide such apparatus that includes apparatus attached to the fishing string at the surface that provides a seal between the upper end of the fishing string and the swab line to allow drilling mud to be pumped down the fishing string and to allow rotation of the fishing string relative to the swab line to operate a packer by rotation of the fishing string.

These and other objects, advantages, and features of this invention will be apparent to those skilled in the art from a consideration of this specification, including the attached drawings and appended claims.

Figure 2:
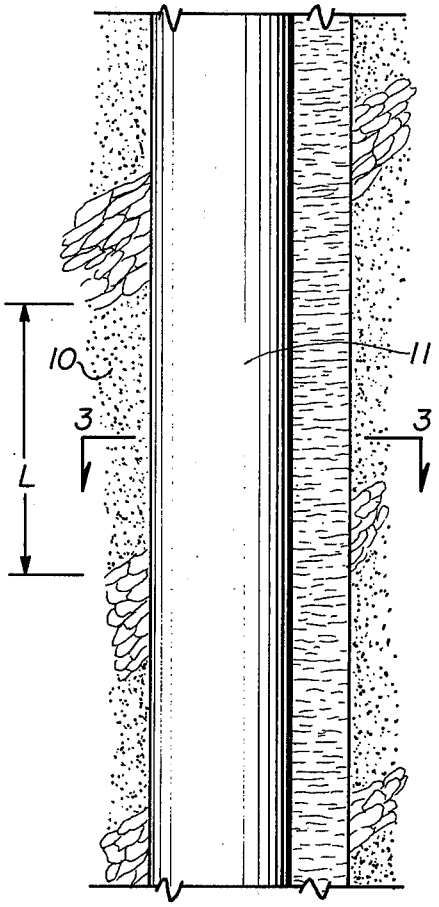
FIG. 2 is a view in elevation of the section of drill string that is stuck against the side of the well bore by differential pressure.
Figure 3:
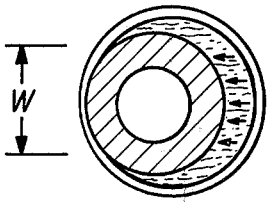
FIG. 3 is a sectional view taken along 3—3 of FIG. 2.

As explained above, the most common cause for a drill string to become stuck in a well bore during a drilling operation is differential pressure sticking. This results when a formation through which the well bore extends, such as formation 10 in FIG. 2, contains a fluid having a formation pressure that is less than the hydrostatic pressure exerted in the well bore by the drilling fluid opposite the formation. It is also a prerequisite that the formation is sufficiently permeable that the higher pressure drilling fluid will tend to flow, at least to some extent, into the formation. Under these conditions, when the drill string is stationary for one reason or another, for example, as when making a connection, and a portion or section of drill string engages the wall of the well bore, as shown in FIGS. 2 and 3, the high pressure of the drilling fluid will hold the section tightly against the side of the well bore with what can amount to a tremendous force.

For example, if the formation pressure in formation 10 (FIG. 2) in 4500 p.s.i., and the hydrostatic pressure in the well bore is 5000 p.s.i., then there is a differential pressure of 500 p.s.i. available to hold the portion of the drill string adjacent the formation against the wall of the well bore. The drilling mud deposits a thin film of solid material that coats the wall of the well bore, which is called wall cake, and the drill string, when forced against the wall, will become imbedded in the wall cake which acts as a seal to prevent the drilling mud from contacting the surface of the drill string that is imbedded in the wall cake. If, for example, the section of drill string imbedded is of an effective width W, as shown in FIG. 3, and this extends over a length L, as shown in FIG. 2, then the force holding the drill string against the wall of the well bore will be equal to the differential pressure times the product of WL. That this can be a substantial force can be illustrated by assuming conditions that can readily exist in any well bore. Usually, it is the drill collar section of the drill string that is most susceptible to wall sticking because they have a larger diameter than the rest of the string. If the diameter of drill collars 11 is 6 inches, and the collars become imbedded in the wall cake such that W is approximately 3.75 inches and this extends over a length L of 20 feet, then a differential pressure of 500 p.s.i. will exert a force of 450,000 lbs. holding collars 11 against the wall of the well bore. Obviously, a substantial amount of force would be required to pull the pipe free. In fact, usually more force than the pipe can withstand in tension, particularly if the stuck collars are several thousand feet below the surface. Therefore, other means must be provided to decrease this holding force and release the drill string.

Certain apparatus is used to practice this invention that is not normally in the drill string during normal drilling operations, although it could be. Assuming it is not, the first step is to unscrew a tool joint in the drill string at some point above the stuck portion. This is a very conventional, well known procedure.

If a safety joint is in the string above the drill collars, and it is the collars that are stuck, then the safety joint can be unscrewed and the pipe string above the joint removed. alternatively, the free point of the string is determined with a free point indicator and a small explosion is set off adjacent a tool joint while torque is applied to the tool joint tending to unscrew it. The shock of the explosion will usually cause the tool joint to back off or unscrew and the section of drill string above this joint can be removed from the hole.

Next, a fishing string, including the apparatus for practicing this invention, is made up at the surface and run back in the hole. At the lower end will be a fishing tool (not shown) of the desired type, such as an overshot, to engage the upwardly extending portion of the pipe string above the stuck section and connect the fishing string to the stuck portion or fish. This will allow the fishing string to exert an upward pull on the fish, when desired, and also a downward force can be applied, if desired. Usually, jars are run above the overshot to provide an impact force against the fish. In the practice of this invention, however, jars probably would not be necessary although they may be run as a precautionary event so that they would be in the string if needed.

In accordance with this invention, means are provided to seal the annular area between the drill string and the well bore above the stuck section and to lower the hydrostatic pressure of the drilling fluid opposite the formation against which the section is being held.

A packer is used to provide the required seal. The packer can be located at various places in the string. If sufficient surface casing is set, the packer can be located so that it will establish its seal between the fishing string and the surface casing. As will be explained in detail below, it must be located at a point below the surface sufficient to allow the hydrostatic pressure to be lowered sufficiently to free the fish.

Figure 4:
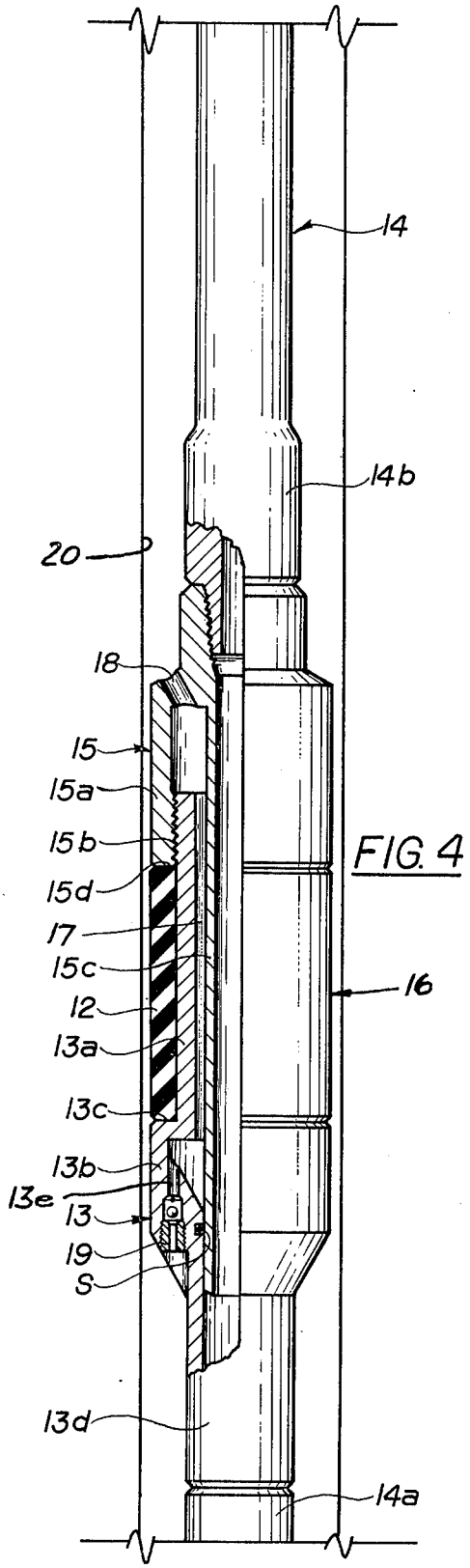
FIG. 4 is a view, partly in section and partly in elevation, of a packer in the unset position for use with the apparatus and in the practice of the method of this invention.
Figure 5:
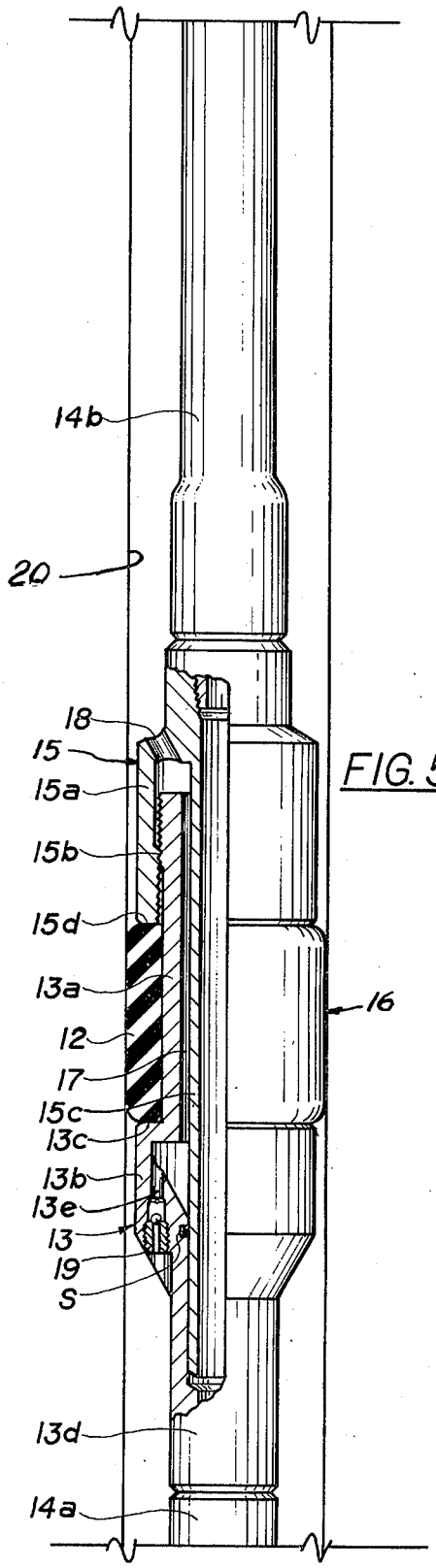
FIG. 5 is a view of the packer of FIG. 4 in the set position.
Figure 6:
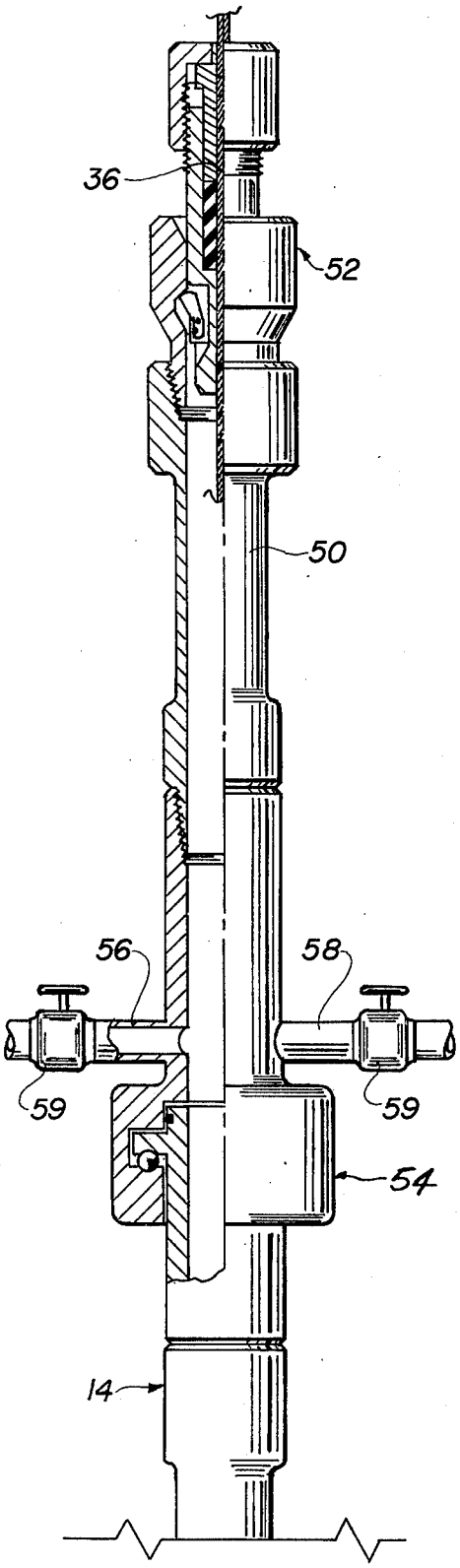
FIGS. 6 and 7 are views, partly in section and partly in elevation, of the apparatus at the surface including the apparatus for providing a seal between the swab line and the fishing string and the apparatus for rotating the fishing string relative to the swab line.

Various types of packers can be used to accomplish the purpose desired, however, a packer having the characteristics of the packer shown in FIGS. 4 and 5 is preferred. Packer 16 has annular packing element 12 mounted on packer body 13. The body includes cylindrical portion 13*a* which extends through the central opening in packing element 12. It also has lower portion 13*b* of larger diameter to provide annular shoulder 13*c* to engage the lower end of the packing element. The lower end of the body is connected to portion 14*a* of the fishing string below the packer through tool joint section 13*d*.

The upper end of body 13 is connected to portion 15*a* of packer mandrel 15 through threads 15*b*. The mandrel also includes elongated cylindrical portion 15*c* that extends through cylindrical portion 13*a* of the body and portion 15*c* of the mandrel for purposes to be described below. The lower end of the mandrel engages seal S carried by the body to prevent fluid flowing though the mandrel and packer body from entering the annular space between the two members.

In operation, after the fishing string has been connected to the fish through a fishing tool, rotation of upper portion 14*b* of the fishing string will move annular shoulder 15*d* of the mandrel toward shoulder 13*c* of the body compressing packing element 12 longitudinally causing it to move laterally into sealing engagement with the packer body and wall 20 of the well bore, as shown in FIG. 5.

In accordance with this invention, the hydrostatic pressure of the fluid adjacent the fish is reduced by lowering the level of the drilling mud in the fishing string. In the embodiment shown, this is accomplished by swabbing drilling fluid out of the fishing string from the surface. Swabbing drilling mud out of the fishing string will lower the level of the mud in the well bore, and consequently the hydrostatic pressure in the hole even without a seal between the fishing string and the well bore. However, this would require the removal of a much larger volume of mud, which means more time to free the fish, more time during which there is a reduced volume of mud in the hole, and moe time to fill up the hole when the fish has been freed, all of which is undesirable. With the packer set, only the level of liquid in the drill string determines the hydrostatic pressure in the well bore below the packer. Thus, with 4½ inch drill pipe, the removal of only about 15 barrels of mud will drop the fluid level approximately 1000 feet in the drill string.

As drilling mud is swabbed out of the fishing string to lower the hydrostatic pressure in the well bore, fluid from an exposed formation below the packer may begin to enter the well bore. Such fluid will have a lower density than the drilling mud so the differential pressure at the fish will drop even if most of the mud removed is replaced by formation pressure. Therefore, it may be possible to obtain a sufficient reduction in differential pressure to free the fish under these conditions. This situation would have to be watched very closely, however, because the inflow of formation fluid, particularly if it contained gas, could develop into a kick. Should this occur, it will be necessary to reestablish circulation through the drill pipe and up the annular space of the well bore thereby interrupting the fishing operations long enough to circulate out the kick. To do this without taking the time to remove the swab from the drill pipe, the swabbing apparatus shown in FIG. 1 is provided.

Figure 1:
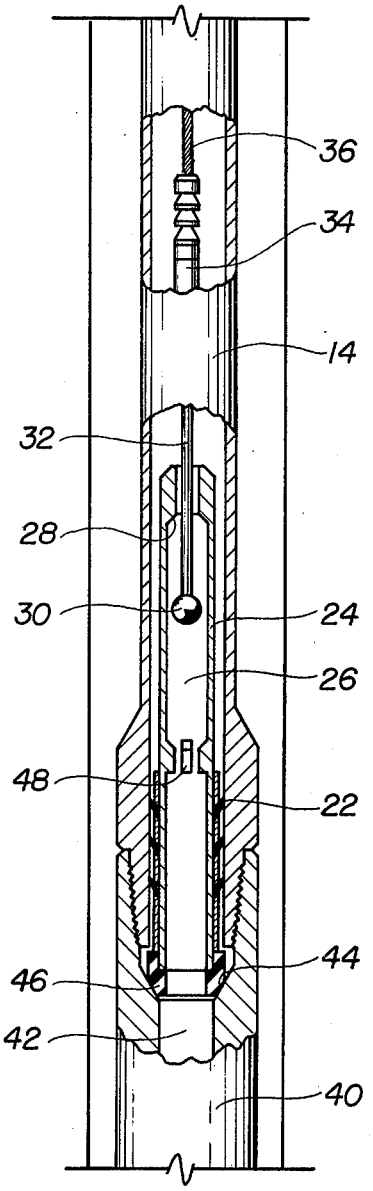
FIG. 1 is a view partly in elevation and partly in vertical section of a section of the drill string adapted to limit the downward travel of the swab used to remove drilling mud from the drill string to reduce the hydrostatic pressure exerted by the fluid in the drill string.

As shown in FIG. 1, the swabbing apparatus includes a swab cup assembly having swab cup 22 mounted on mandrel 24 for operation in the bore of fishing string 14. Mandrel 24 is provided with bore 26 thorugh which fluid can flow. At the upper end of the mandrel, the diameter of bore 26 is reduced to provide valve seat 28 which combines with ball 30 carried by rod 32 to act as a check valve and prevent the flow of fluid downwardly through bore 26 when the swab assembly is being supported with ball 30 in engagement with valve seat 28. This would be the case when the swab is being pulled under the load of a head of drilling fluid. Rod 32 is connected to wireline socket 34, which in turn in connected to sandline 36 for raising and lowering the swab to swab drilling mud out of the drill pipe.

Special sub 40 is provided at a selected point in the fishing string. Sub 40 is designed to support the swab cup assembly and allow ball 30 to be moved downwardly away from seat 28 and allow fluid to be circulated through the bore of swab mandrel 26. Sub 40 has bore 42 of reduced diameter providing upwardly tapered surface 44. The lower end of the swab cup assembly includes annular member 46 of resilient material that will engage inclined surface 44. By slacking off on the sandline, ball 30 is moved downwardly away from valve seat 28 and drilling mud can be pumped through bore 26 down the fishing string and out the bit and up through the annulus in the conventional manner. Bore 26 of the swab mandrel is provided with fingers or lugs 48, which limit the distance ball 32 can move downwardly through the bore.

When circulating, of course, the packer will have to be released or, alternatively, in accordance with one of the features of this invention, valve means are provided to allow fluid to bypass the packer during normal circulation.

In the embodiment shown in FIGS. 4 and 5, one or more passages 13*e* extend through lower portion 13*b* of the packer body. These passages connect annular space 17 to the annulus below the packer allowing fluid to flow through the body, annular space 17, and into the annular above the packer through one or more passages 18 in the mandrel. Check valve 19 located in passage 13*e* allows such upward flow, thereby permitting conventional circulation with the packer set. The valve will not allow such flow in the reverse direction.

At the surface, fishing string 14 is connected to lifting sub 50 to allow the string to be supported by the elevators (not shown) of the drilling rig, and to allow an upward pull to be placed on the fish. Wire line stripper 52 is attached to sub 50 to provide a seal between wire line 36 and the upper end of the fishing string. A stripper of the releasable type is shown. Swivel 54 is connected into the string below sub 50 to allow the portion of the string below the swivel to be freely rotated as required, for example, to set the packer. Flow lines 56 and 58 extend laterally from the swivel. The mud swabbed from the fishing string can be discharged through one of these lines back to the mud pits. The other can be connected to the mud pumps for circulating mud down the fishing string if this should become necessary during the fishing operation. Valves 59 are provided to control the flow through the lines.

Figure 7:
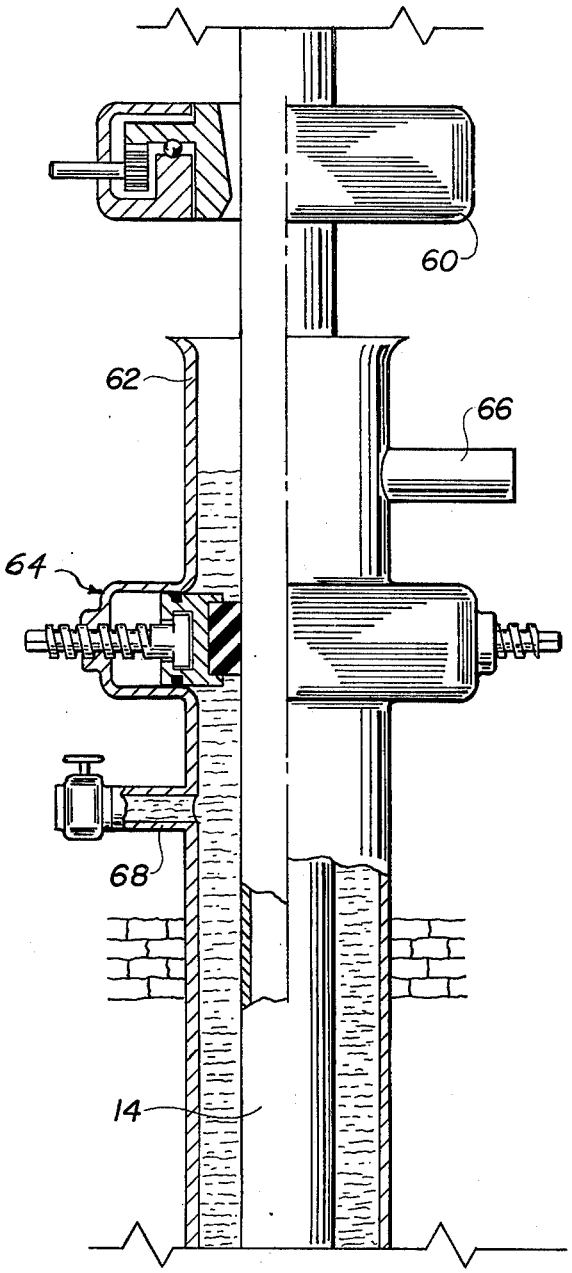

FIG. 7 shows additional surface equipment that is usually present. This includes rotary table 60, shown schematically, bell nipple 62, blowout preventer 64, mud return line 66, and fill up line 68.

In summary, in the practice of the method of this invention, after the fishing string is connected to the fish an upward pull is placed on the fish through the fishing string. This is done to provide a force urging the fish to move to thereby reduce the amount the differential pressure must be reduced and it also provides an immediate indication at the surface when the fish comes loose. Next, a seal is established between the fishing string and the well bore at the desired point above the fish. Then the level of the drilling fluid in the fishing string is lowered until the differential pressure between the hydrostatic pressure of the drilling fluid and the formation pressure has been reduced sufficiently to allow the fish to be moved away from the wall of the well bore.

The distance the liquid level must be lowered to accomplish this will depend, of course, upon the differential pressure and the specific gravity of the drilling fluid or mud being used. For example, using the 500 p.s.i. differential pressure discussed above, if 16 lb. per gallon mud is in the well bore, then the liquid level of the mud in the drill pipe would need to be reduced only 600 ft. to reduce the hydrostatic pressure by 500 p.s.i. For 12 lb. per gallon mud, the level of the drilling mud would have to be lowered approximately 800 ft., and for 10.7 lb. per gallon mud, 900 ft. Of course, normally, the fish can be pulled out of engagement with the wall of the well bore before the pressures are completely equalized.

From the foregoing, it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the method and apparatus of this invention without departing from the scope thereof, it is to be understood that all matter herein set forth or shown in the accompanying drawings is to be interpreted as illustrative and not in a limiting sense.

The invention having now been described, what is claimed is:

1. A method of releasing a portion of a drill string that is stuck in a well bore due to differential pressure holding it against the wall of the well bore, comprising the steps of placing a seal between the drill string and the well bore to prevent the downward flow of fluid in the annulus above the seal and lowering the fluid level in the drill string to release the pressure differential holding the stuck portion until it can be pulled free of the wall of the well bore.

2. A method of reducing the differential pressure between the hydrostatic pressure in the well bore to release a portion of a pipe string held against the wall of the well bore due to differential pressure sticking, comprising the steps of placing a seal between the drill string and the well bore far enough below the surface for the pressure of the drilling mud above the seal to be at least equal to the differential pressure reguired to hold the stuck portion against the formation and swabbing sufficient drilling mud out of the drill string to lower the differential pressure sufficiently to allow the stuck portion to be moved away from the wall of the well bore adjacent the formation.

3. Apparatus for recovering a drill string held against the wall of a well bore by differential pressure sticking, comprising means providing a seal between the drill string and the well bore above the stuck portion and means for lowering the level of drilling fluid in the drill string to reduce the hydrostatic pressure of the drilling mud sufficiently to allow the pipe string to be moved away from the wall of the well bore.

4. The apparatus of claim 3 in which the means for lowering the liquid level comprises a swab cup assembly and means for lowering and raising the swab cup assembly in the drill string to lower the level of drilling mud therein.

5. The apparatus of claim 4 in which the swab cup assembly includes a swab cup and a mandrel for supporting the swab cup, the mandrel having a bore through which fluid can flow to bypass the swab cup and vlave means movable by the lowering and raising means between a closed position when the swab is being pulled upwardly to remove fluid from the drill string and an open position when the swab is being lowered.

6. The apparatus of claim 5 in which the drill string includes a sub for limiting the downward travel of the swab cup assembly whereby the valve means can be moved to its open position to allow fluid to be pumped down the drill string through the swab cup assembly mandrel and bypass the swab cup.

7. The apparatus of claim 3 further provided with valve means for allowing drilling fluid to flow upwardly around the seal means so that dulling mud may be circulated down the drill string and upwardly between the drill string and the wall of the well bore while maintaining the seal between the drill string and the well bore when required.

8. Apparatus for recovering a stuck section of drill string that is held against the wall of the well bore by differential pressure comprising a fishing string having a fishing tool on its lower end for connecting the fishing string to the stuck section, a packer carried by the fishing string for setting in the annulus to provide a seal in the annulus between the fishing string and the wall of the well bore above the stuck section, means for allowing drilling fluid flowing upwardly in the annulus to bypass the packer so that drilling fluid can be circulated down the fishing string and up the annulus when required without unseating the packer, and means for lowering the level of drilling fluid in the fishing string to reduce the hydrostatic pressure of the drilling mud sufficiently to allow the stuck section to be moved away from the wall of the well bore and removed from the well bore by the fishing string.

9. The apparatus of claim 8 in which the packer includes an annular packing element, means for compressing the packing element upon rotation of the portion of the fishing string above the packer relative to the portion of the fishing string below the packer to cause the packing element to expand laterally into sealing engagement with the drill string and the wall of the well bore to prevent the downward flow of drilling fluid in the annulus above the packer.

10. The apparatus of claim 9 in which the means for lowering the level of drilling fluid in the fishing string includes a swab, a flexible swab line extending into the upper end of the fishing string to raise and lower the swab in the fishing string to remove drilling fluid therefrom, means for providing a seal between the swab line and the upper end of the fishing string to allow drilling fluid to be pumped into the fishing string with the swab and swab line in the fishing string, valve means carried by the swab for allowing drilling fluid to flow downwardly through the fishing string when the valve is open, and means for opening the valve when the swab is lowered to a predetermined position in the fishing string.

* * * * *